United States Patent [19]

Shea

[11] Patent Number: 4,509,214

[45] Date of Patent: Apr. 9, 1985

[54] WEIGHT LIFTER'S BELT INCORPORATING PULLEY MECHANISM

[76] Inventor: Lance L. Shea, 2933 N. 83rd St., Scottsdale, Ariz. 85251

[21] Appl. No.: 189,070

[22] Filed: Sep. 22, 1980

[51] Int. Cl.[3] ..... A41F 9/00

[52] U.S. Cl. ..... 2/322; 2/237; 2/338; 2/DIG. 6

[58] Field of Search ..... 2/322, 321, 237, 318, 2/338, 339, 340, 336, 311, DIG. 6; 24/68 E, 68 F, 164, 163 R, 68 R, 81 AA, 197, 199, 200, 201, 31 V, 204, 81 A, 265 BC, 74 R

[56] References Cited

U.S. PATENT DOCUMENTS

| | | | |
|---|---|---|---|
| 1,137,499 | 4/1915 | Lieberman | 2/237 |
| 1,601,173 | 9/1926 | Hill | 2/338 X |
| 2,281,086 | 4/1942 | Blankenhorn | 2/237 |
| 3,014,256 | 12/1961 | Derrickson et al. | 24/163 R X |
| 3,112,496 | 12/1963 | Dritz | 2/338 X |
| 3,591,866 | 7/1971 | Jensen | 24/31 V X |
| 3,777,315 | 12/1973 | Norfolk | 2/321 |
| 4,273,130 | 6/1981 | Simpson | 2/338 X |

FOREIGN PATENT DOCUMENTS

| | | | |
|---|---|---|---|
| 505424 | 5/1939 | United Kingdom | 2/237 |

*Primary Examiner*—H. Hampton Hunter

*Attorney, Agent, or Firm*—Cahill, Sutton & Thomas

[57] ABSTRACT

A waist belt for weight lifting incorporates a pulley arrangement for tightening the belt. The waist belt includes a heavy leather belt having first and second ends. First and second rectangular metal loops are secured proximate the first and second ends, respectively, of the leather belt, each of the rectangular metal loops including a cylindrical roller rotatably mounted thereto. A nylon strap is secured at a fixed end to the leather belt proximate the second end thereof, and the free end of the strap is wound over the rollers of the first and second metal loops to form a pulley arrangement for drawing the ends of the leather belt together. First and second complementary fastening surfaces are secured to the free end of the strap and to the leather belt, respectively, for removably attaching the free end of the strap to the leather belt after the belt has been sufficiently tightened.

10 Claims, 3 Drawing Figures

WEIGHT LIFTER'S BELT INCORPORATING PULLEY MECHANISM

BACKGROUND OF THE INVENTION

1. Field of the Invention

The present invention relates generally to belts, and more particularly, to a weight lifter's belt incorporating a pulley mechanism for tightening the belt.

2. Description of the Prior Art

In the sport of weight lifting, participants frequently wear a waist belt to properly support their bodies in order to prevent injury thereto. Conventional weight lifting belts are made of heavy leather and include a plurality of tongues at one end of the belt for engaging a corresponding plurality of buckles attached to the opposite end of the belt. Typically, such weight lifting belts are approximately four inches wide and one-quarter inch thick, the permissible range of width and thickness being specified by international sport federations.

Weight lifting belts must be secured very tightly in order for the wearer to obtain proper support therefrom. However, it is very difficult for the wearer to sufficiently tighten the belt by himself. Accordingly, it is not unusual for two other persons to pull the ends of the belt together in order to sufficiently tighten the belt for proper support while the wearer engages the buckles. Similarly, it is very difficult for the wearer to remove the tightened belt by himself, and the help of another person is frequently required to unbuckle the belt.

In order to obtain proper support from a weight lifting belt, a weight lifter must wear a belt having a length which is sized to his particular physique. Therefore, organizations that provide facilities for training weight lifters must typically purchase a relatively large number of weight lifting belts having various lengths in order to accommodate all persons using the facilities. The cost of purchasing such a relatively large number of weight lifting belts is considerable.

Tremendous tensional forces are applied to a weight lifting belt when the wearer is lifting weights, particularly in the case of heavyweight classes of competition. These tensional forces are transmitted directly to the tongues and buckles of conventional weight lifting belts and apply significant stresses thereto.

Accordingly, it is an object of the present invention to provide a weight lifting belt which can be sufficiently tightened and fastened by the wearer alone in order to provide himself with proper support, and which belt can be easily removed by the wearer alone.

It is another object of the present invention to provide a weight lifting belt which can be used by weight lifters having widely varying physiques.

It is a further object of the present invention to provide a weight lifting belt which evenly distributes tensional forces at a plurality of points disposed along the belt.

These and other objects of the present invention will become apparent to those skilled in the art as the description thereof proceeds.

SUMMARY OF THE INVENTION

Briefly described and in accordance with one embodiment thereof, the present invention relates to a waist belt for weight lifting wherein the waist belt incorporates a pulley arrangement for tightening the belt. The waist belt includes a belt having first and second ends. First and second strap engaging members are secured to the belt proximate the first and second ends thereof. A flexible strap has a fixed end secured to the belt proximate the second end thereof and also has a free end opposite the fixed end. The free end of the flexible strap is wound over the first strap engaging member and is then wound over the second strap engaging member for forming a pulley arrangement in order to tighten the belt when the free end of the strap is pulled.

Preferably, the first and second strap engaging members each include a roller for rotatably engaging the flexible strap. First and second complementary fastening surfaces are secured to the free end of the flexible strap and to the belt, respectively, for removably attaching the free end of the strap to the belt after the belt has been sufficiently tightened.

In the preferred embodiment of the invention, the waist belt includes an additional flexible strap having a tension-bearing end secured to the belt, and the second fastening surface is attached to the additional flexible strap. The flexible strap and the additional flexible strap are removably secured to the belt for allowing the first and second fastening surfaces to be conveniently replaced periodically.

Preferably, the fixed end of the flexible strap and the second strap engaging member are secured to the belt at points spaced apart from one another to distribute tensional forces along the belt. Similarly, the tension-bearing end of the additional flexible strap is secured to the belt at a point spaced apart from the points at which the first and second strap engaging members are secured to the belt to further distribute tensional forces along the belt.

DETAILED DESCRIPTION OF THE PREFERRED EMBODIMENT

Figure 1:
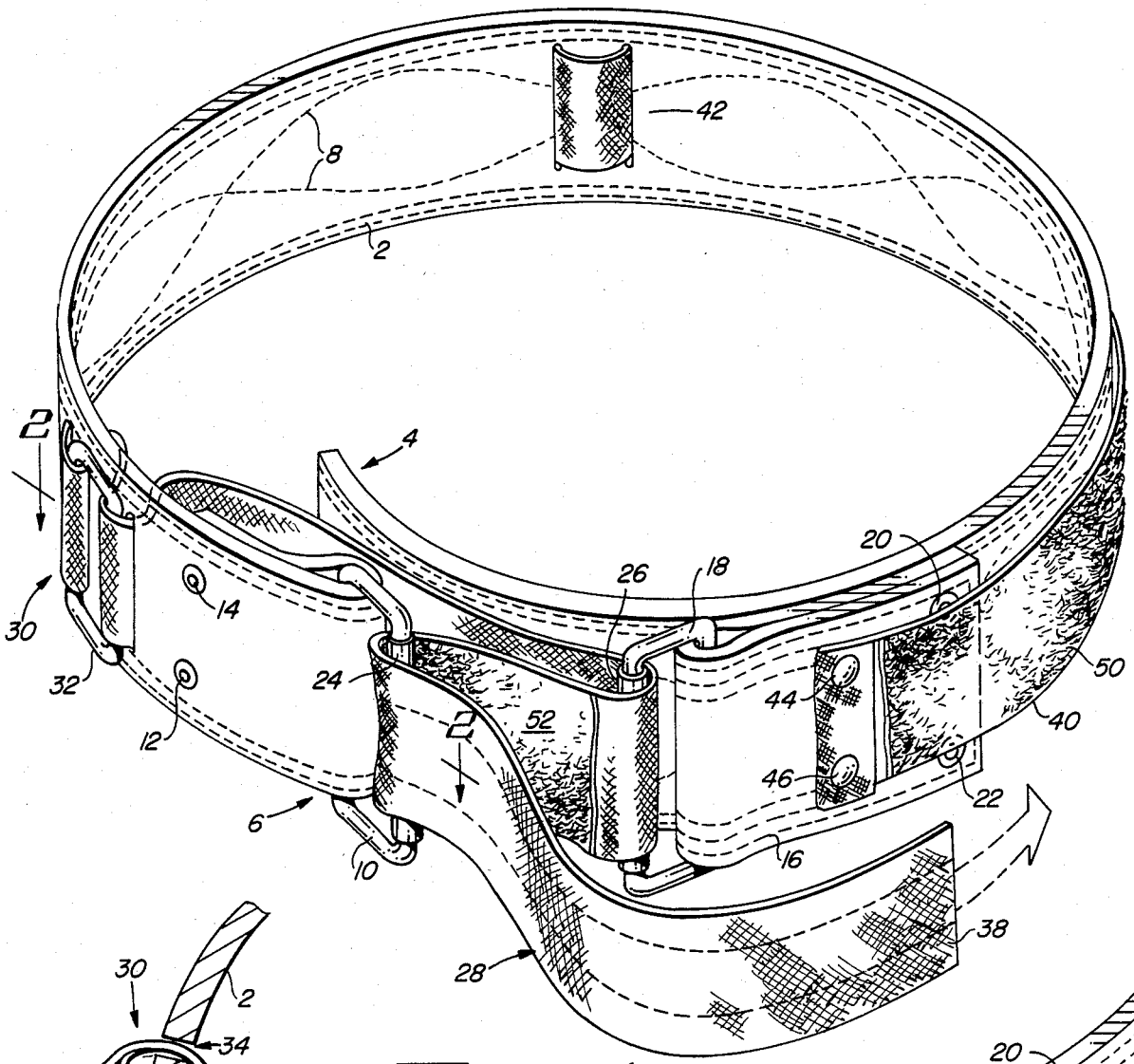
FIG. 1 is a perspective view of a weight lifting belt incorporating a pulley arrangement according to the teachings of the present invention.

FIG. 1 illustrates a waist belt for weight lifting which includes a heavy leather belt 2 having a first end generally designated 4 and a second end generally designated 6. Leather belt 2 is approximately four inches wide and approximately one-quarter inch in thickness and may be formed of two or more layers of leather sewn together by stitching 8 as shown in FIG. 1.

Figure 2:
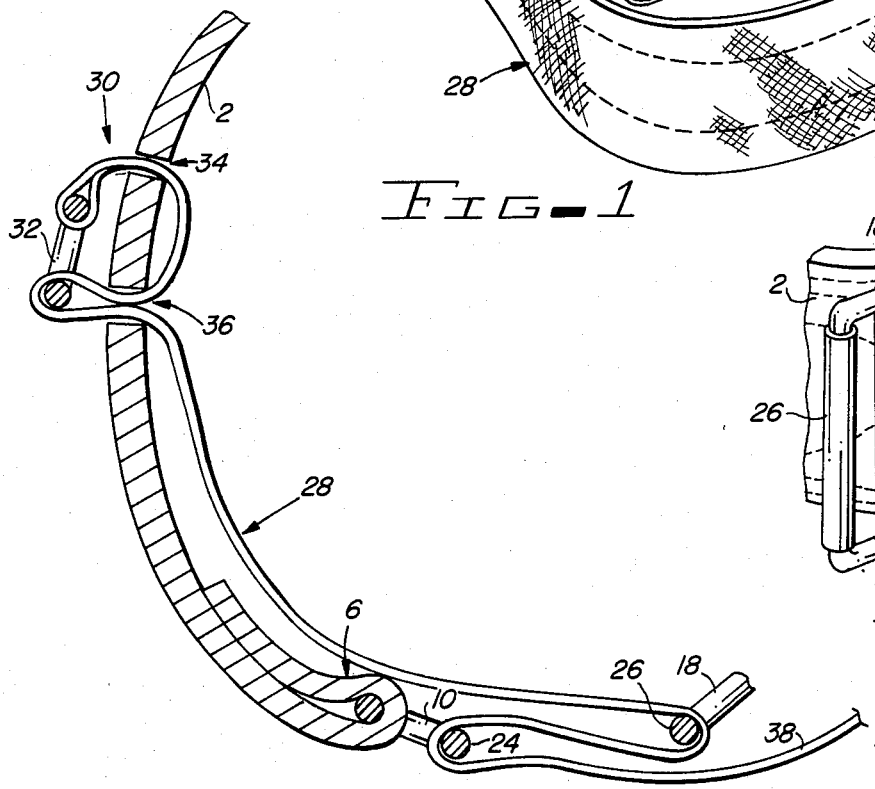
FIG. 2 is a cross-sectional view taken through lines 2—2 shown in FIG. 1 and illustrating the manner in which a flexible strap is wound over rollers secured proximate opposite ends of the belt to form the pulley arrangement.
Figure 3:
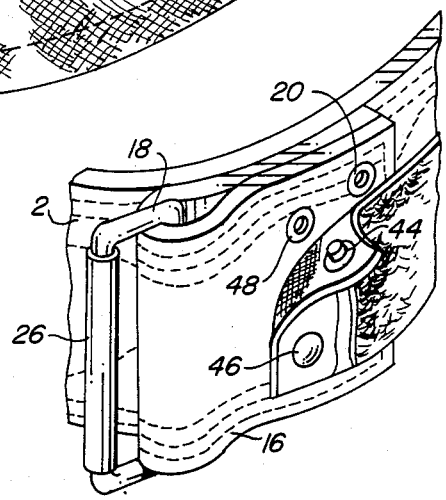
FIG. 3 is a perspective view of a portion of the belt shown in FIG. 1.

As shown in FIGS. 1 and 2, second end 6 of leather belt 2 passes through a rectangular metal loop 10 and is overlapped upon itself. Rivets 12 and 14 secure the overlapped portions of second end 6 together. As shown in FIGS. 1 and 3, a piece of heavy leather 16 passes through a rectangular metal loop 18 and is overlapped upon itself. The overlapped portions of leather piece 16 are secured to each other and to leather belt 2 proximate first end 4 by rivets 20 and 22. Preferably, first end 4 of belt 2 extends approximately six to twelve inches beyond rectangular metal loop 18 for allowing ends 4 and 6 of belt 2 to overlap one another even if the wearer has a relatively large physique. As shown in FIGS. 1–3, cylindrical rollers 24 and 26 are rotatably secured to rectangular metal loops 10 and 18, respectively.

Referring now to FIGS. 1 and 2, a flexible strap 28, preferably made of nylon, is provided to form a pulley mechanism in conjunction with rollers 24 and 26 for tightening belt 2. Strap 28 has a fixed end, designated generally by reference numeral 30, which passes through a rectangular metal loop 32 and overlaps itself, the overlapped portions being secured to one another as by stitching. As shown best in FIG. 2, belt 2 has a pair of slots 34 and 36 formed therein proximate second end 6. The free end 38 of strap 28 opposite fixed end 30 is inserted through slot 34 from the outer face of belt 2 and is inserted through slot 36 from the inner face of belt 2. After exiting slot 36, free end 38 extends through and around rectangular metal loop 32 and is inserted back through slot 36 from the outer face of belt 2 for removably securing fixed end 30 of strap 28 to belt 2.

When the wearer puts belt 2 around his waist, free end 38 of strap 28 is advanced toward loop 18. Free end 38 is then passed under roller 26, through rectangular metal loop 18, and around roller 26 for allowing roller 26 to rotatably engage strap 28 at a first point disposed between fixed end 30 and free end 38. Free end 38 is then passed under roller 24, through rectangular metal loop 10, and around roller 24 for allowing roller 24 to rotatably engage strap 28 at a second point disposed between the first point and free end 38. In order to tighten belt 2, free end 38 is pulled in the direction indicated by the dashed arrow within FIG. 1. The pulley arrangement formed by rollers 24 and 26 and strap 28 effectively multiplies the pulling force applied at free end 38 of strap 28 for tightening belt 2.

Referring now to FIGS. 1 and 3, an additional flexible strap 40, preferably made of nylon, has a tension-bearing end, designated generally by reference numeral 42, secured to the rear portion of belt 42 approximately intermediate first end 4 and second end 6. Tension-bearing end 42 of additional strap 40 is secured to belt 2 in a similar manner to that used to secure fixed end 30 of strap 28 to belt 2. The end of additional strap 40 opposite tension-bearing end 42 is provided with snap-type fasteners 44 and 46. A complementary snap-type fastener 48 is attached to leather piece 16 opposite fastener 44 for engagement therewith. Similarly, a second complementary snap-type fastener (not shown) is attached to leather piece 16 opposite fastener 46 for engagement therewith.

Stitched to the outward side of additional strap 40 is a fastening surface 50, and stitched to strap 28 along the inwardly facing surface thereof is a complementary fastening surface 52.Fastening surfaces 50 and 52 may be of the type commercially available from American Velcro, Inc. under the registered trademark "VELCRO"; one of the fastening surfaces 50 and 52 comprises an all-nylon tape covered with finely woven monofilaments formed into permanent hooks, while the other of such fastening surfaces is an all-nylon tape covered with soft nylon loops. Such fastening surfaces removably engage and adhere to one another when pressed together.

After the wearer of the belt has pulled free end 38 of strap 28 to sufficiently tighten belt 2, free end 38 of strap 28 is pressed against additional strap 40 for contacting fastening surface 52 against fastening surface 50. The tension thereby transmitted from free end 38 of strap 28 to additional strap 48 is, in turn, transmitted to belt 2 at tension-bearing end 42. When it is desired to remove the belt, the wearer merely lifts free end 38 of strap 28 away from additional strap 40 for disengaging fastening surfaces 50 and 52; the wearer then unthreads strap 28 from rectangular metal loops 10 and 18 in order to remove belt 2.

Those skilled in the art will appreciate that the pulley arrangement formed by strap 28 and rollers 24 and 26 allows the wearer of the belt to sufficiently tighten and fasten the belt without the aid of other persons. It will also be appreciated that additional rollers may be secured to belt 2 and that strap 28 may be wound around these additional rollers for further multiplying the force applied to free end 38 of strap 28 in order to tighten belt 2. It will also be noted that the inner diameter of belt 2 can be adjusted to accommodate weight lifters having widely different physiques. Strap 28 and fastening surface 52 attached thereto are sufficiently long to allow strap 28 to overlap additional strap 40 and to allow fastening surfaces 50 and 52 to contact one another when the belt is tightened, regardless of the physique of the particular wearer.

Those skilled in the art will also appreciate that a belt constructed according to the teachings of the present invention more uniformly distributes tensional forces across the length of the belt than in the prior art. Fixed end 30 of flexible strap 28 and rectangular metal loop 10 are secured to belt 2 at points spaced apart from one another for distributing tensional forces applied to second end 6 of belt 2. Similarly tension-bearing end 42 of additional strap 40 and rectangular metal loop 18 are secured to belt 2 at points spaced apart from one another for distributing tensional forces applied to first end 4 of belt 2.

It will also be noted that strap 28 and additional strap 40 are easily removable from belt 2 for allowing convenient replacement thereof. Periodic replacement of strap 28 and additional strap 40 may be desirable in order to provide fresh fastening surfaces 50 and 52 for use in conjunction with belt 2. The manner in which fixed end 30 of strap 28 and first end 42 of additional strap 40 are anchored to belt 2 allows strap 28 and additional strap 40 to transmit tensional forces to belt 2 while allowing strap 28 and additional strap 40 to be easily removable from belt 2.

While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. A waist belt for weight lifting, said waist belt comprising in combination:

a. a belt having first and second ends;

b. a flexible strap having a fixed end secured to said belt proximate the second end thereof, said flexible strap having a free end opposite the fixed end;

c. first means secured to said belt proximate the first end thereof for engaging said flexible strap at a first point disposed between the fixed end and free end thereof;

d. second means secured to said belt proximate the second end thereof for engaging said flexible strap at a second point disposed between the first point and the free end thereof;

e. said flexible strap, said first means, and said second means forming a pulley arrangement for tightening said belt when the free end of said flexible strap is pulled; and f. means to secure said belt when tightened.

2. A waist belt as recited in claim 1 wherein said first and second means each include a roller for rotatably engaging said flexible strap.

3. A waist belt as recited in claim 2 wherein said first and second means each include a metal loop secured to said belt and wherein said roller is rotatably secured to said metal loop.

4. A waist belt as recited in claim 1 wherein said belt is made of leather and said flexible strap is made of nylon.

5. A waist belt as recited in claim 1 wherein said securing means includes means for removably attaching the free end of said flexible strap to said belt after said belt is tightened.

6. A waist belt as recited in claim 5 wherein said attaching means comprises first and second complementary fastening surfaces for removably engaging each other, said first fastening surface being secured to the free end of said flexible strap and said second fastening surface being secured to said belt for removably attaching the free end of said flexible strap to said belt when said first and second fastening surfaces are brought in contact with one another.

7. A waist belt as recited in claim 6 further including an additional flexible strap having a tension-bearing end secured to said belt, said second fastening surface being attached to said additional flexible strap for transmitting tension applied by the free end of said flexible strap to the tension-bearing end of said additional flexible strap.

8. A waist belt as recited in claim 7 wherein said flexible strap and said additional flexible strap are removably secured to said belt.

9. A waist belt as recited in claim 7 wherein the tension-bearing end of said additional flexible strap is secured to said belt at a point spaced apart from the points at which said first and second means are secured to said belt in order to distribute tension along said belt.

10. A waist belt as recited in claim 1 wherein the fixed end of said flexible strap and said second means are secured to said belt at points spaced apart from one another to distribute tension along said belt.

* * * * *